US009468246B2

(12) United States Patent
Hamilton

(10) Patent No.: US 9,468,246 B2
(45) Date of Patent: Oct. 18, 2016

(54) BUTTON REPAIR SYSTEM AND METHOD

(71) Applicant: Elaine T. Hamilton, Kansas City, MO (US)

(72) Inventor: Elaine T. Hamilton, Kansas City, MO (US)

( * ) Notice: Subject to any disclaimer, the term of this patent is extended or adjusted under 35 U.S.C. 154(b) by 0 days.

(21) Appl. No.: 14/667,332

(22) Filed: Mar. 24, 2015

(65) Prior Publication Data

US 2015/0196079 A1 Jul. 16, 2015

Related U.S. Application Data

(63) Continuation of application No. 13/450,248, filed on Apr. 18, 2012, now abandoned.

(60) Provisional application No. 61/476,640, filed on Apr. 18, 2011.

(51) Int. Cl.

| | |
|---|---|
| ***A41H 37/00*** | (2006.01) |
| ***A44B 1/34*** | (2006.01) |
| ***A44B 1/18*** | (2006.01) |

(52) U.S. Cl.

CPC ..... *A41H 37/001* (2013.01); *A44B 1/185* (2013.01); *A44B 1/34* (2013.01); *Y10T 24/45267* (2015.01); *Y10T 29/4995* (2015.01)

(58) Field of Classification Search

CPC ..... A44B 1/185; A44B 1/28; A44B 1/36; A44B 1/32; A44B 1/44; A44B 1/08; A44B 1/24; A44B 1/42; A44B 5/002; A44B 9/12; A44B 1/34; A41H 37/008; A41H 37/10; A41H 37/00; A41H 37/001

USPC ..... 24/114.7; 411/457, 510

See application file for complete search history.

(56) References Cited

U.S. PATENT DOCUMENTS

| | | | | |
|---|---|---|---|---|
| 1,478,932 | A | 12/1923 | Wetz et al. | |
| 1,480,746 | A | 1/1924 | De Bie | |
| 1,598,597 | A | 9/1926 | Baggerud | |
| 1,690,129 | A * | 11/1928 | Prentiss | A43B 3/0078 24/108 |
| 1,808,535 | A | 6/1931 | Erwin | |
| 2,104,885 | A | 1/1938 | Robins | |
| 2,137,713 | A | 11/1938 | Conner | |
| 2,228,043 | A | 1/1941 | Baggerud | |
| 3,142,878 | A * | 8/1964 | Santora | A44B 1/42 24/113 R |
| 4,035,874 | A * | 7/1977 | Liljendahl | A44B 1/34 24/107 |
| 4,131,975 | A | 1/1979 | Niedecker | |
| 4,194,272 | A | 3/1980 | Taffurelli | |
| 4,232,427 | A | 11/1980 | Mawhinney et al. | |
| 4,534,350 | A | 8/1985 | Golden et al. | |
| 4,573,469 | A | 3/1986 | Golden et al. | |
| 4,627,437 | A | 12/1986 | Bedi et al. | |
| 4,662,034 | A | 5/1987 | Cunningham | |
| 4,693,248 | A | 9/1987 | Fallia | |
| 5,584,104 | A | 12/1996 | Stuart | |
| 5,674,245 | A | 10/1997 | Ilgen | |
| 8,769,775 | B2 * | 7/2014 | Rantfors | A44B 1/185 24/114.7 |

* cited by examiner

*Primary Examiner* — Robert J Sandy
*Assistant Examiner* — Rowland Do
(74) *Attorney, Agent, or Firm* — Law Office of Mark Brown, LLC; Christopher M. DeBacker

(57) ABSTRACT

A button replacement and reinforcement system which provides a quick and simple alternative to sewing a button into place. This system is versatile in that it can be used on buttons with one or up to four holes. It provides a secure attachment or reinforcement to button placement, and is also able to add buttons as an embellishment to a variety of materials, including materials. It is quick and simple to use, and hold buttons securely in place without the need for a needle or thread.

2 Claims, 4 Drawing Sheets

BUTTON REPAIR SYSTEM AND METHOD

CROSS-REFERENCE TO RELATED APPLICATION

This application is a continuation of U.S. patent application Ser. No. 13/450,248, filed Apr. 18, 2012, which claims priority in U.S. Provisional Patent Application No. 61/476,640, filed Apr. 18, 2011, both of which are incorporated herein by reference.

BACKGROUND OF THE INVENTION

1. Field of the Invention

The present invention relates generally to the field of button replacement and reinforcement, and more specifically to a thread-less system and method for replacing a button on a piece of material.

2. Description of Related Art

The present system solves a long-desired need for a quick alternative to button repair and replacement other than the tedious process of using a needle and thread. Its intended uses are to instantly reconnect missing buttons and support existing buttons that are loose. It may also be used to add buttons where there were none before, and for the addition of buttons for ornamental decoration.

Often buttons become loose, or fall off at times when a traditional repair of using needle and thread is inconvenient. The present invention provides a quick and easy solution to button repair and replacement, as well as adding buttons as a decorative embellishment.

Heretofore there has not been available a single-use applicator with the features and elements of the present invention.

BRIEF SUMMARY OF THE INVENTION

In the practice of the present invention, included are the functions of a "button repair system", a system that not only securely replaces, but creates a secure support for loose buttons. This system also creates a secure way to embellish and decorate material with buttons.

This system can be used on many types of material and is versatile enough to be inserted through buttons with one or up to four holes.

The materials used to design this system will include, but not be limited to casting resin, plastic, or metal with safety features designed to protect the user from getting stuck by the sharp ends while giving it the ability to go through varied, even thick material easily. The notches fasten for user protection.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

An embodiment of the present invention is generally designed to provide a semi-permanent solution to attaching a button 8 to material 9, such as an article of clothing, without the use of needle and thread.

II. Threadless Button Replacement System 2

Figure 1:
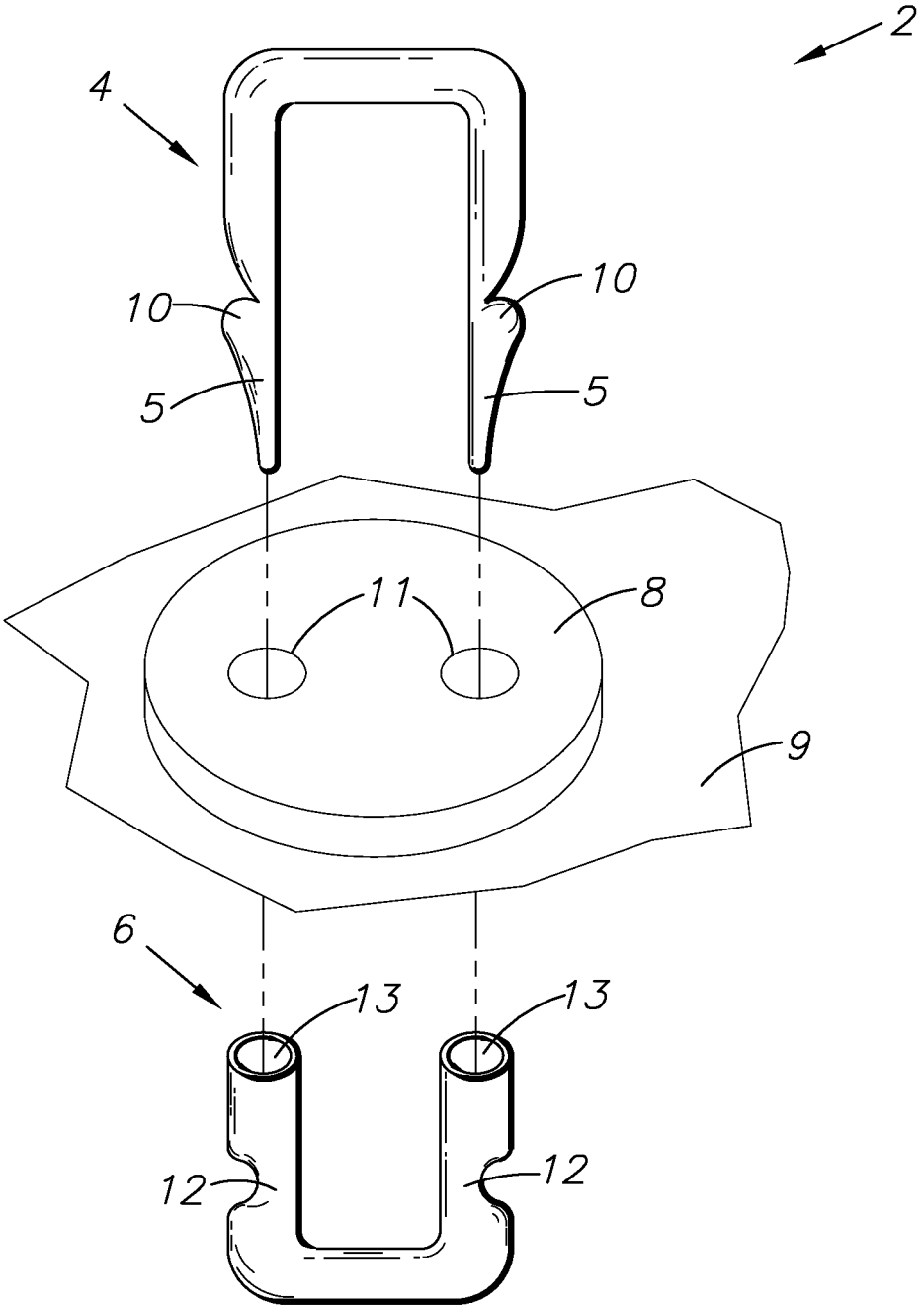
FIG. 1 is an isometric view of a button repair system, showing how the top portion would pass through a button and connect with the bottom portion.
Figure 2:
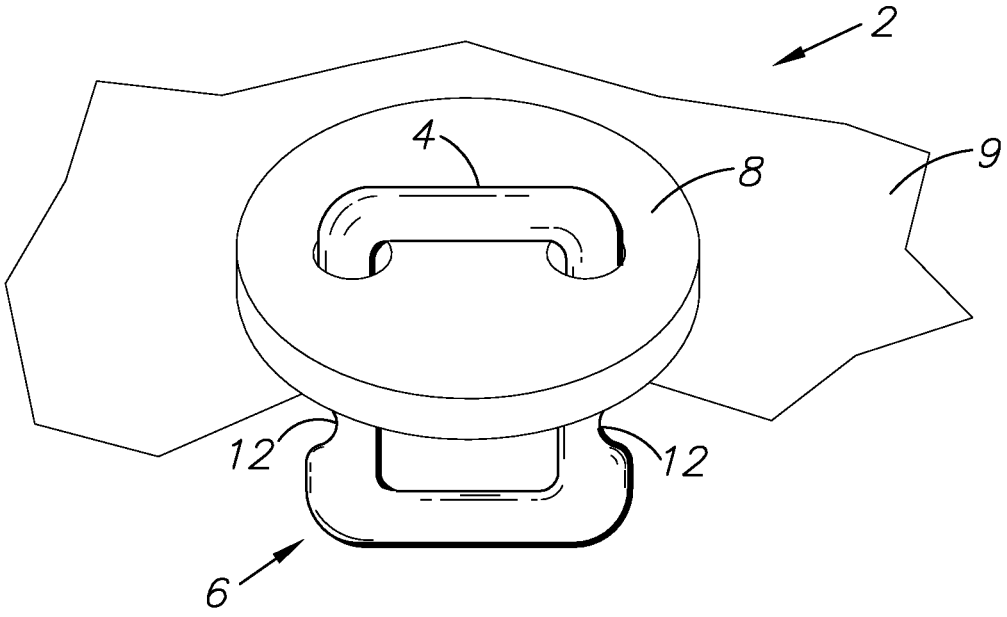
FIG. 2 is an isometric view of a button repair system, wherein the top and bottom portions have joined through a button.

Referring now to the invention in more detail, FIGS. 1 and 2 demonstrate an exemplary button replacement system 2. It includes a top fastener portion 4 and a bottom clamp or receiver portion 6. Both the fastener 4 and the receiver 6 generally form a "U" shape. A button 8 containing at least two button holes 11 is placed against a piece of material 9. The fastener portion 4 is placed above the button 8, and the receiver portion 6 is placed on the back side of the material.

Figure 3:
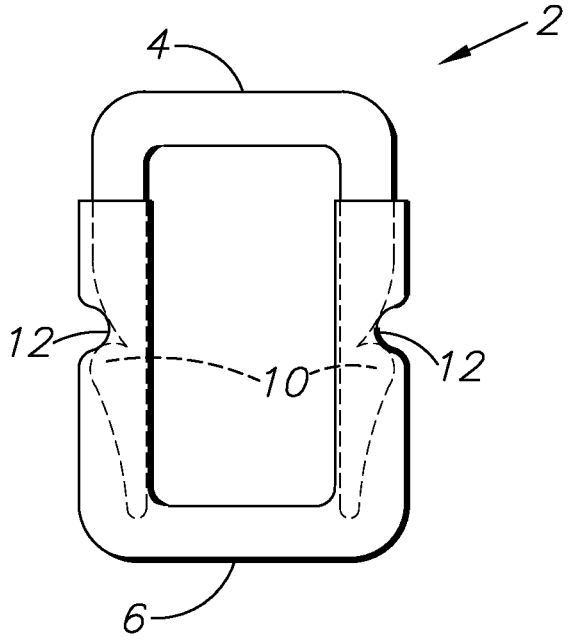
FIG. 3 is a front elevational view of a button repair system, showing in detail the connection between the top and bottom portions thereof.

The fastener portion 4 includes a pair of barbs 5 which include a protrusion 10. These barbs are capable of penetrating the material 9 and entering the receiving holes 13 of the receiver portion 6. The receiver portion 6 further includes a clamp indention 12 which acts to receive the barb protrusion 10 of the fastener portion and lock the fastener in place, as shown in more detail in FIG. 3. Although sufficient force may be able to separate this connection, it should be solid enough to form a semi-permanent connection between the fastener 4 and the receiver 6.

Figure 4:
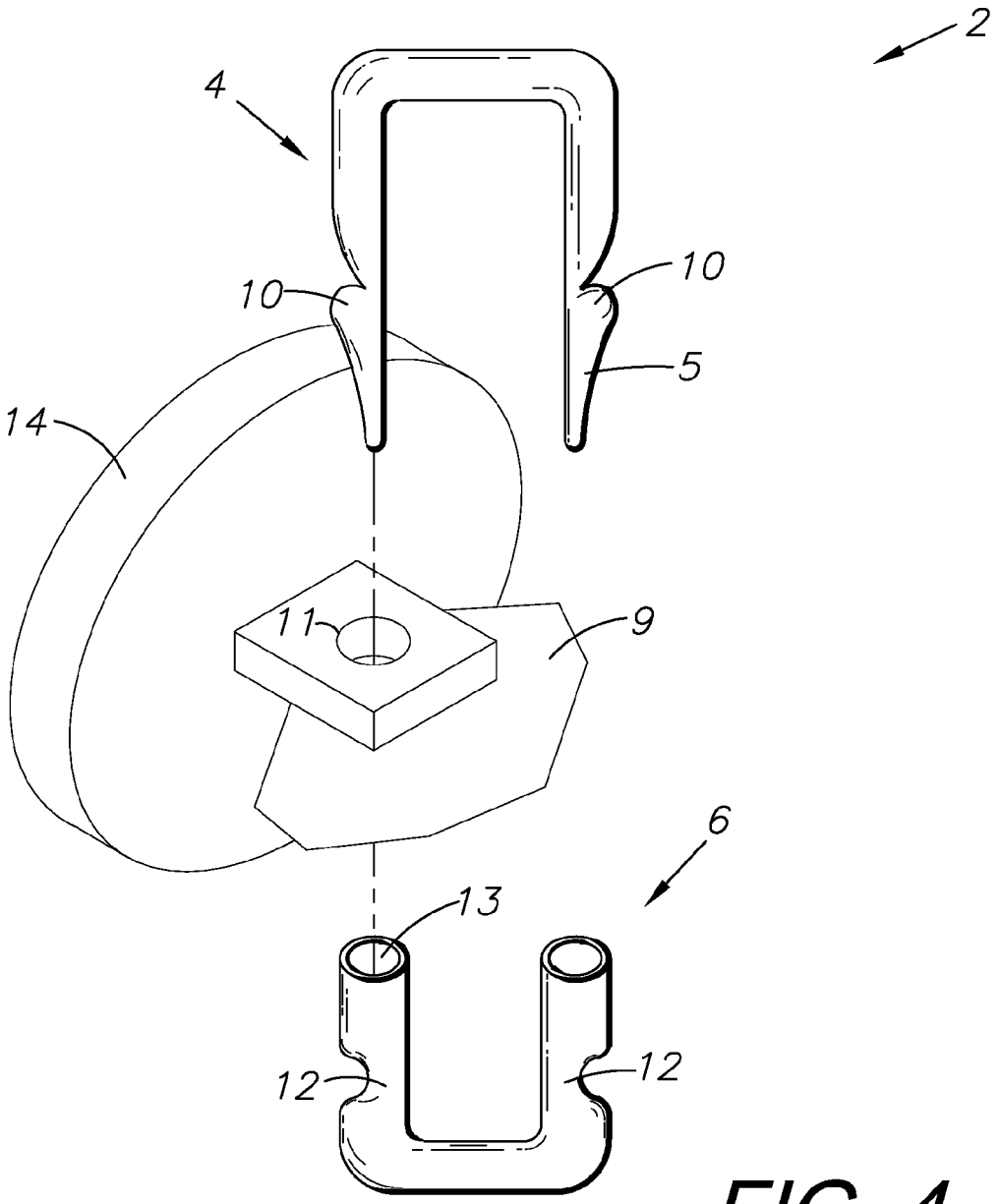
FIG. 4 is an isometric view of a button repair system showing a connection with an alternative button type.

As shown in FIG. 4, the fastener 4 and receiver 6 can be used on buttons with only one hole 11 at the back of the button 14. The Fastener 4 is inserted through the button hole 11 or loop at the back of the button 14, is then inserted through the material 9, and finally locks into the receiver 6.

It is to be understood that the invention can be embodied in various forms, and is not to be limited to the examples discussed above. The range of components and configurations which can be utilized in the practice of the present invention is virtually unlimited.

Having thus described the invention, what is claimed as new and desired to be secured by Letters Patent is:

1. A method for replacing a button on a piece of cloth, the method comprising the steps:

placing a receiver consisting of a single-element, U-shaped body against a rear face of the piece of cloth, said receiver body further comprising a receiver cross-piece including a proximal end and a distal end, a first receiver leg piece joined to said crosspiece proximal end, and a second receiver leg piece joined to said crosspiece distal end;

placing a button in against a front face of the piece of cloth in proximity to said receiver, said button comprising at least one button hole;

inserting a fastener through said at least one button hole, said fastener comprising a fastener crosspiece including a proximal end and a distal end, a first fastener leg piece joined to said crosspiece proximal end, and a second fastener leg piece joined to said crosspiece distal end;

piercing said cloth with barbed ends of said first and second fastener leg pieces, wherein each barbed end includes a protrusion;

inserting said first and second fastener legs into said first and second receiver leg pieces, respectively;

permanently locking said first and second fastener leg pieces into said respective first and second receiver leg pieces by retaining said barbed end protrusions within locking indentions located along said first and second receiver legs;

said first and second fastener leg pieces forming perpendicular angles with said fastener crosspiece, generally creating a "U" shape; and said first and second receiver leg pieces forming perpendicular angles with said receiver crosspiece, generally creating a "U" shape.

2. The method of claim 1, wherein said piece of cloth further comprises a clothing garment selected from the list comprising: a shirt, a pair of trousers, a skirt, a blouse, a jacket, a coat, a pair of short-pants, and a hat.

* * * * *